US006270071B1

(12) United States Patent
Asada

(10) Patent No.: US 6,270,071 B1
(45) Date of Patent: Aug. 7, 2001

(54) SHEET SUPPLY DEVICE

(75) Inventor: Tetsuo Asada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/362,312

(22) Filed: Jul. 28, 1999

(30) Foreign Application Priority Data

Jul. 30, 1998 (JP) ..... 10-215698

(51) Int. Cl.[7] ..... B65H 3/06
(52) U.S. Cl. ..... 271/119; 271/109
(58) Field of Search ..... 271/119, 120, 271/109

(56) References Cited

U.S. PATENT DOCUMENTS 4,905,984 * 3/1990 Haigh ..... 271/118
5,372,359 * 12/1994 Miura et al. ..... 271/119
5,437,444 * 8/1995 Kawakami et al. ..... 271/121
5,582,399 * 12/1996 Sugiura ..... 271/119
5,857,671 * 1/1999 Kato et al. ..... 271/119
6,070,867 * 6/2000 Tsurumi et al. ..... 271/119

* cited by examiner

*Primary Examiner*—H. Grant Skaggs
(74) *Attorney, Agent, or Firm*—Oliff & Berridge, PLC.

(57) ABSTRACT

To provide a sheet supply device including a long life sheet supply roller. A large radius portion 10*a* of a sheet supply roller 10 is gradually abraded in association with passage of operation time. Protrusions 12*a* of an idle roller 12 initially contact a rotational shaft 14 without forming any play between the protrusions 12*a* and the rotational shaft 14. However, friction force generated between the tips of the protrusions 12 and the rotational shaft 14 wears down the protrusions 12*a*. As a result, a difference between the radius of the large radius portion 10*a* and the radius of the idle roller 12 will be hardly decreased even after a cumulative operation time. Therefore, even after the abrasion progresses, sheet supply operations will be operated properly.

14 Claims, 8 Drawing Sheets

WORN DOWN CONDITION

INITIAL CONDITION

WORN DOWN CONDITION

INITIAL CONDITION

SHEET SUPPLY DEVICE

BACKGROUND OF THE INVENTION

1. Field of the Invention

The present invention relates to a sheet supply device.

2. Description of the Related Art

A sheet supply device is used in image forming devices and other office equipment. As shown in FIGS. 1(*a*) and 1(*b*), a conventional sheet supply device includes a sheet supply roller 80, an idle roller 82, and a rotational shaft 84, that all rotate around the same axis. The sheet supply roller 80 has a large radius portion 80*a* and a small radius portion 80*b*. The large radius portion 80*a* has a radius greater than the radius of the idle roller 82. The small radius portion 80*b* has a radius smaller than the radius of the idle roller 82. When the rotational shaft 84 is driven to rotate, the sheet supply roller 80 rotates along with the rotational shaft 84. On the other hand, the idle roller 82 is freely rotatable around the rotational shaft 84. A stack of sheets S are provided at a predetermined sheet supply position beneath the idle roller 82. Although not shown in the drawings, an urging member is disposed at a side of the sheet S opposite from the idle roller 82, and urges the sheet S toward the idle roller 82.

When sheet supply operations are not being performed, the small radius portion 80*b* of the sheet supply roller 80 confronts the surface of the sheet S at the sheet supply position, and the idle roller 82 contacts the surface of the sheet S. In this way, the idle roller 82 maintains a minimum distance between the rotational shaft 84 and the sheet S.

When sheet supply operations are started, the rotational shaft 84 is driven to rotate in a direction indicated by an arrow B in FIG. 1(*a*), and the sheet supply roller 80 rotates in association with the rotational shaft 84. As a result, as shown in FIG. 1(*a*) the large radius portion 80*a* of the sheet supply roller 80 comes into contact with the sheet S, and the idle roller 82 is separated from the sheet S. As the sheet supply roller 80 further rotates, the sheet S is fed toward the sheet feed rollers 86, 88 because of friction between the sheet supply roller 80 and the sheet S. When the front edge of the sheet S reaches the sheet feed rollers 86, 88, the sheet feed rollers 86, 88 pick up the sheet S and further transport the sheet S.

After the sheet S is picked up by the sheet feed rollers 86, 88, the small radius portion 80*b* again comes into confrontation with the sheet S. As a result, as shown in FIG, 1(*b*), the idle roller 82 comes into contact with the sheet S, and the sheet supply roller 80 is separated from the sheet S. Then, the rotation of the sheet supply roller 80 is stopped. However, because the idle roller 82 is freely rotatable about the rotational shaft 84, the idle roller 82 is rotated as the sheet S is fed by the sheet feed roller 86, 88 because of friction generated between the idle roller 82 and the sheet S. Accordingly, the sheet S is smoothly transported without any undesirably large force being generated between the idle roller 82 and the sheet S.

Usually, the large radius portion 80*a* of the sheet supply roller 80 is formed from a soft material, such as rubber, that has a large friction coefficient. Therefore, when the sheet supply roller 80 is used for a long period of time, the outer peripheral surface of the large radius portion 80*a* is gradually worn down by friction. On the other hand, the idle roller 82 is normally formed from a material with a low friction coefficient, and that is much harder than the material of the sheet supply roller 80. For this reason, the idle roller 82 wears down much slower than the sheet supply roller 80.

Accordingly, the difference between the radius of the large radius portion 80*a* and the radius of the idle roller 82 is gradually reduced with passage of time.

The relationship of the radius of the large radius portion 80*a* and the radius of the idle roller 82 with respect to the passage of time is shown in graphical form in FIG. 2. After the sheet supply roller 80 has been operated for a cumulative operation time of t1, the difference between the radius of the large radius portion 80*a* and the idle roller 82 reaches a minimum tolerance value A. When the difference is reduced to lower than the minimum tolerance value A, sheets S will quite frequently be improperly picked up by the sheet supply roller 80, thereby preventing proper sheet supply operations.

Therefore, the sheet supply roller 80 must be replaced with a new one before the cumulative operation time of the sheet supply roller 80 exceeds the value t1. However, the sheet supply roller 80 is expensive to replace, so it is desirable to increase the life of the sheet supply roller 80.

SUMMARY OF THE INVENTION

It is an objective of the present invention to overcome the other described problems and also to provide a sheet supply device which has a sheet supply roller with a longer life.

In order to achieve the above and other objectives, there is provided a sheet supply device including a rotatable shaft, a sheet supply roller, and at least one idle roller. The sheet supply roller is fixed to the shaft such that the sheet supply roller rotates along with the shaft. The sheet supply roller supplies the recording sheet in a predetermined direction while rotating. The sheet supply roller has a cross-section formed of a large radius segmental portion and a small radius segmental portion. The idle roller is freely rotatably mounted around the shaft and has an inner surface to contact the shaft and an outer surface to contact the recording medium. The idle roller has a distance between the inner surface and the outer surface. At least one of the rotatable shaft and the inner surface of the idle roller is formed so that the inner surface of the idle roller is worn down to decrease the distance between the inner surface and the outer surface because of a friction generated between the shaft and the inner surface of the idle roller.

BRIEF DESCRIPTION OF THE DRAWINGS

The particular features and advantages of the invention as well as other objects will become more apparent from the following description taken in connection with the accompanying drawings, in which:

FIG. 1(*b*) is a cross-sectional view showing a conventional sheet supply device of FIG. 1(*a*), after the sheet supply roller has been rotated in a direction B shown in FIG. 1(*a*);

FIG. 4(*b*) is a cross-sectional view of a sheet feed roller shown in FIG. 4(*a*);

FIG. 5(*b*) is a magnified view showing the worn down condition of the idle roller of FIG. 5(*a*);

FIG. 7(*b*) is a cross-sectional view showing an another modification of the idle roller of the embodiment;

FIG. 7(*c*) is a cross-sectional view showing an another modification of the idle roller of the embodiment;

FIG. 7(*d*) is a cross-sectional view showing an another modification of the idle roller of the embodiment;

FIG. 8(*b*) is a magnified view showing the worn down condition of the rotational shaft of FIG. 8(*a*).

DETAILED DESCRIPTION OF THE PREFERRED EMBODIMENT

A sheet supply device according to a preferred embodiment of the present invention will be described while referring to the accompanying drawings. In the following description, the expression "below" is used throughout the description to define the various parts when the sheet supply device is disposed in an orientation in which it is intended to be used.

Figure 3:
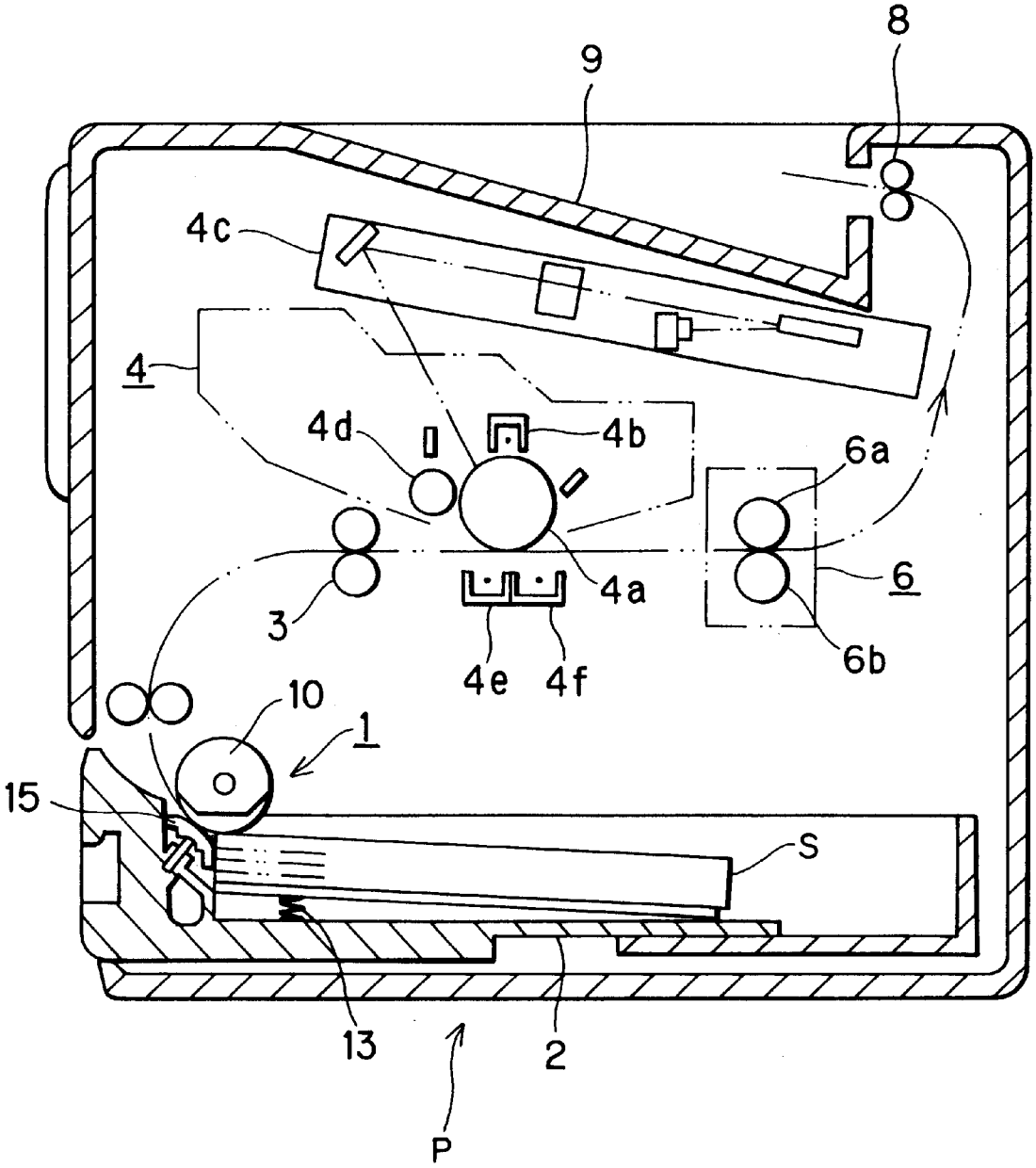
FIG. 3 is a cross-sectional view showing a laser printer including a sheet supply device according to an embodiment of the present invention.

As shown in FIG. 3, a sheet supply device 1 according to the embodiment of the present invention is included in a laser printer P. First, the configuration of the laser printer P will be described while referring to FIG. 3.

As shown in FIG. 3, the laser printer P includes the sheet supply device 1, a sheet supply cassette 2, a pair of resist rollers 3, an image recording unit 4, a thermal fixing unit 6, a discharge unit 8, and a discharge tray 9.

The sheet supply cassette 2 stores a plurality of sheets S in a stacked condition. The plurality of sheets S are urged by a pressing coil 13 against the sheet supply device 1. The sheet supply device 1 supplies the sheet S one at a time from the sheet supply cassette 2 in a sheet transport direction. A separation pad 15 is positioned below the sheet supply device 1 for facilitating separation of one sheet S from the rest of the sheets S in the sheet supply cassette 2. A detailed description of the sheet supply device 1 will be provided later. When the sheet S reaches the pair of resist rollers 3, the resist rollers 3 aligns a front edge of sheet S in a desired fashion. Then, the sheet S is further transported to the image recording unit 4.

The image recording unit 4 includes a drum-shape electrophotographic photosensitive drum 4*a*, a scorotoron type charge unit 4*b*, an exposure unit 4*c*, such as a laser scanner, a developing unit 4*d*, a scorotoron transfer unit 4*e*, and a scorotoron discharge unit 4*f*. The charge unit 4*b* uniformly applies charges to the surface of the photosensitive drum 4*a*. The exposure unit 4*c* irradiates a light from a laser light source (not shown) onto the uniformly charged surface of the photosensitive drum 4*a*. As a result, an electrostatic latent image is formed on the surface of the photosensitive drum 4*a*. The developing unit 4*d* supplies toner particles to the surface of the photosensitive drum 4*a*, thereby forming a toner image corresponding to the electrostatic latent image. The toner image is transferred onto the sheet S by the transport unit 4*e*. As a result, the toner image is formed on the sheet S.

The sheet S with the image formed thereon is transported further downstream toward the thermal fixing unit 6. The thermal fixing unit 6 includes a heat roller 6*a* and a pressure roller 6*b* disposed in confrontation with each other. The heat roller 6*a* generates heat, and the pressure roller 6*b* urges against the heat roller 6*a*. Rotation of the heat roller 6*a* and the pressure roller 6*b* transports the sheet S therebetween while applying heat and pressure to the sheet S. As a result, the toner image formed on the sheet S is thermally fixed onto the sheet S.

Then, the sheet S is discharged by the discharge unit 8 out of the laser printer P onto the discharge tray 9.

Figure 4B:
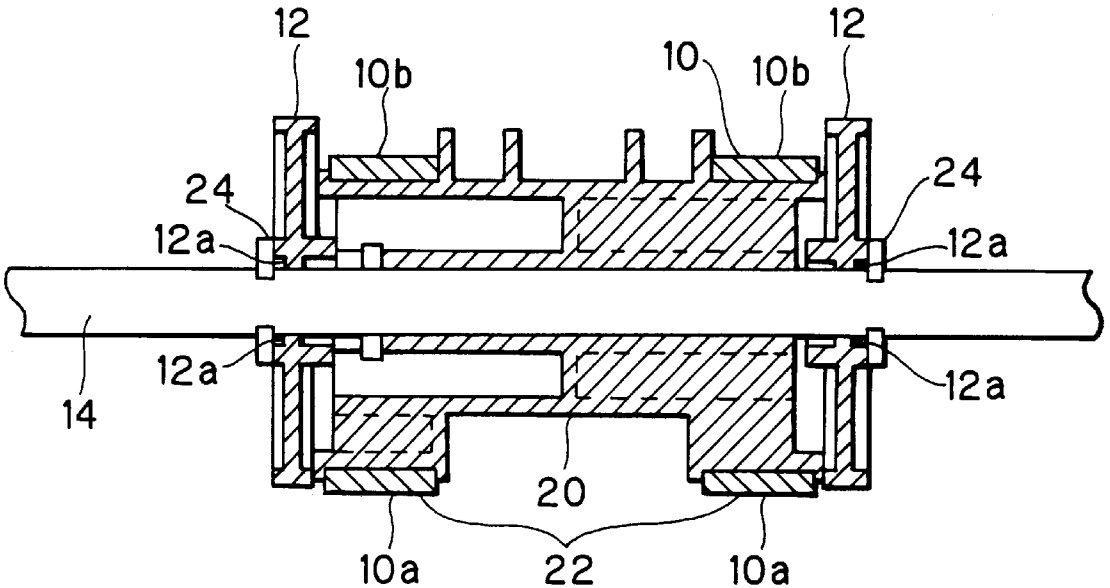
FIG. 4(*a*) is a cross-sectional view showing a sheet supply roller of the sheet supply device of FIG. 3.
Figure 4A:
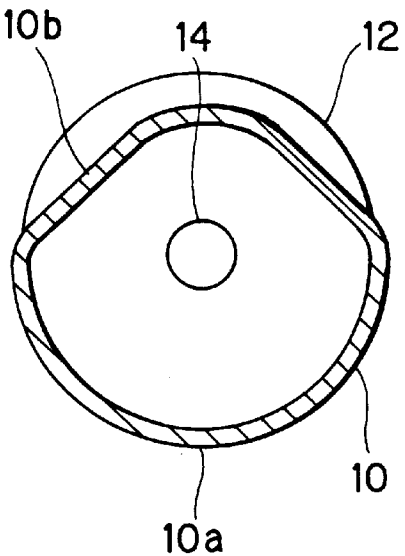

Next, the sheet supply device 1 will be described. As shown in FIGS. 4(*a*) and 4(*b*), the sheet supply device 1 includes a sheet supply roller 10, a pair of idle rollers 12, a rotational shaft 14, and a ring 24, all rotate around the same axis. The rotational shaft 14 is formed from a nickel coated metal. The idle roller 12 is formed from a material, such as polyacetals, which is easily abraded down. The idle roller 12 is freely rotatably disposed on the rotational shaft 14, and is for maintaining a minimum distance between the rotational center of the rotational shaft 14 and the surface of the sheet S. The idle roller 12 has an uneven inner peripheral surface formed with annular-shaped protrusions 12*a* shown in FIG. 4(*b*). The free end tip of the protrusion 12*a* contacts the rotational shaft 14.

The sheet supply roller 10 is fixed to the rotational shaft 14 between the pair of idle rollers 12. As shown in FIG. 4(*b*), the sheet supply roller 10 includes a plastic core 20 and a pair of rubber bands 22. The bands 22 are mounted on the outer peripheral surface of the plastic core 20. The sheet supply roller 10 has a large radius portion 10*a* and a small radius portion 10*b*. The large radius portion 10*a* has a radius larger than a radius of the idle roller 12. The small radius portion 10*b* has a radius smaller than the radius of the idle roller 12. When the rotational shaft 14 is driven to rotate by a driving motor (not shown), the sheet supply roller 10 rotates together with the rotational shaft 14.

It should be noted that, in the present embodiment, the radius of the idle roller 12 indicates a minimum distance between a rotational center of the rotational shaft 14 and an outer surface of the idle roller 12.

The ring 24 is mounted on the rotational shaft 14 at the outer side of the idle roller 12, such that the ring 24 and the sheet supply roller 10 sandwich the idle roller 12 therebetween. The ring 24 prevents the sheet supply roller 10 and the idle roller 12 from changing positions along the rotational shaft 14 in the axial direction.

Figure 1A:
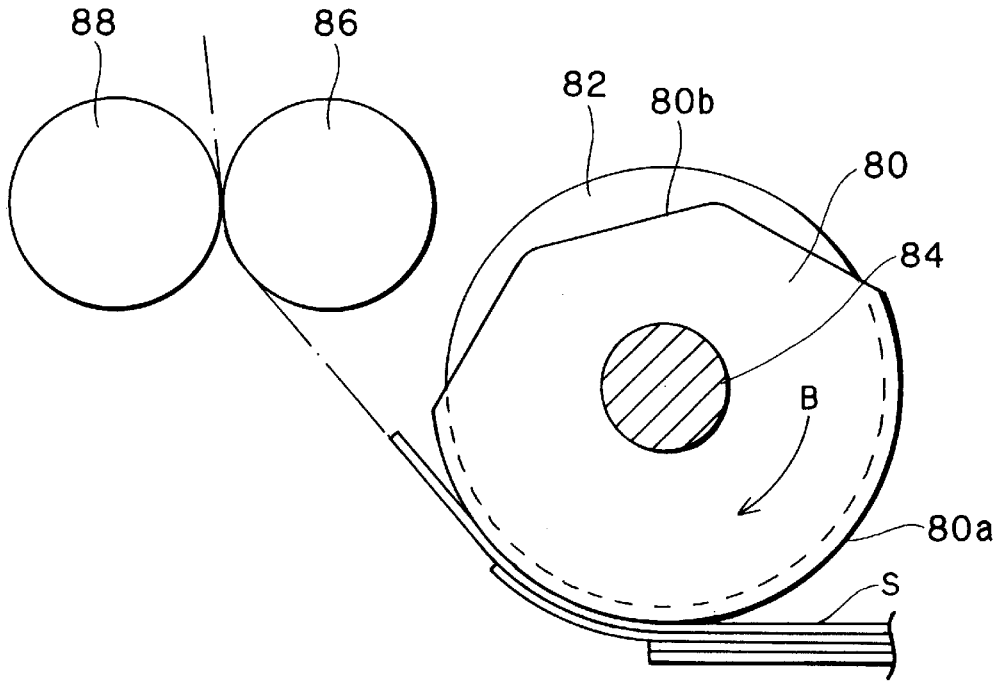
FIG. 1(*a*) is a cross-sectional view showing a conventional sheet supply roller and idle roller of a conventional sheet supply device.
Figure 1B:
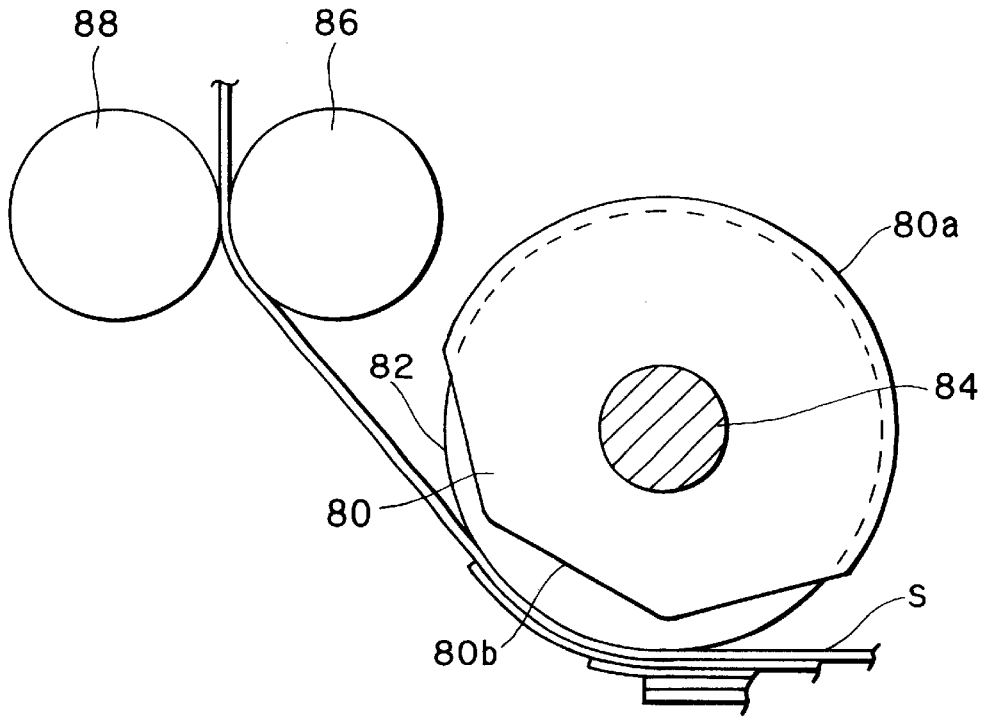
Figure 2:
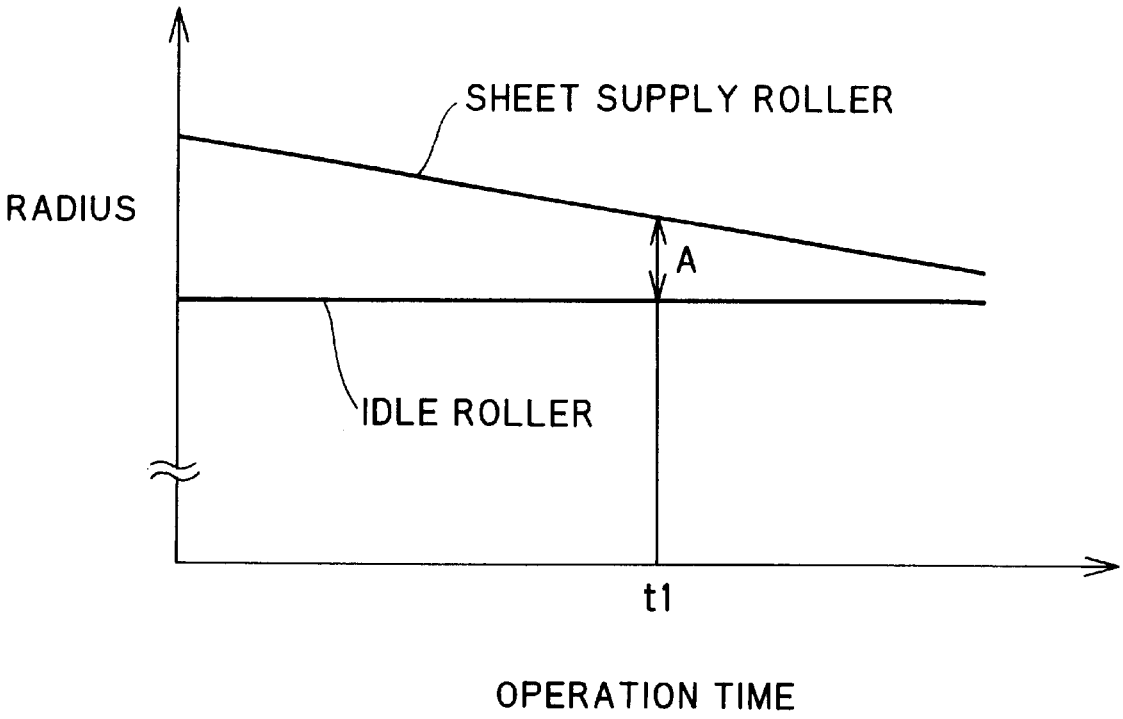
FIG. 2 is a graph showing the relationship between radius of the sheet supply roller and radius of the idle roller with respect to cumulative operation time.

Because the function and operations of the sheet supply device 1 is similar to that of the conventional sheet supply device shown in FIGS. 1(*a*) and 1(*b*), detailed description will be omitted.

Next, the effect of the idle roller 12 having the above-described configuration will be described.

Figures 5A, 5B:
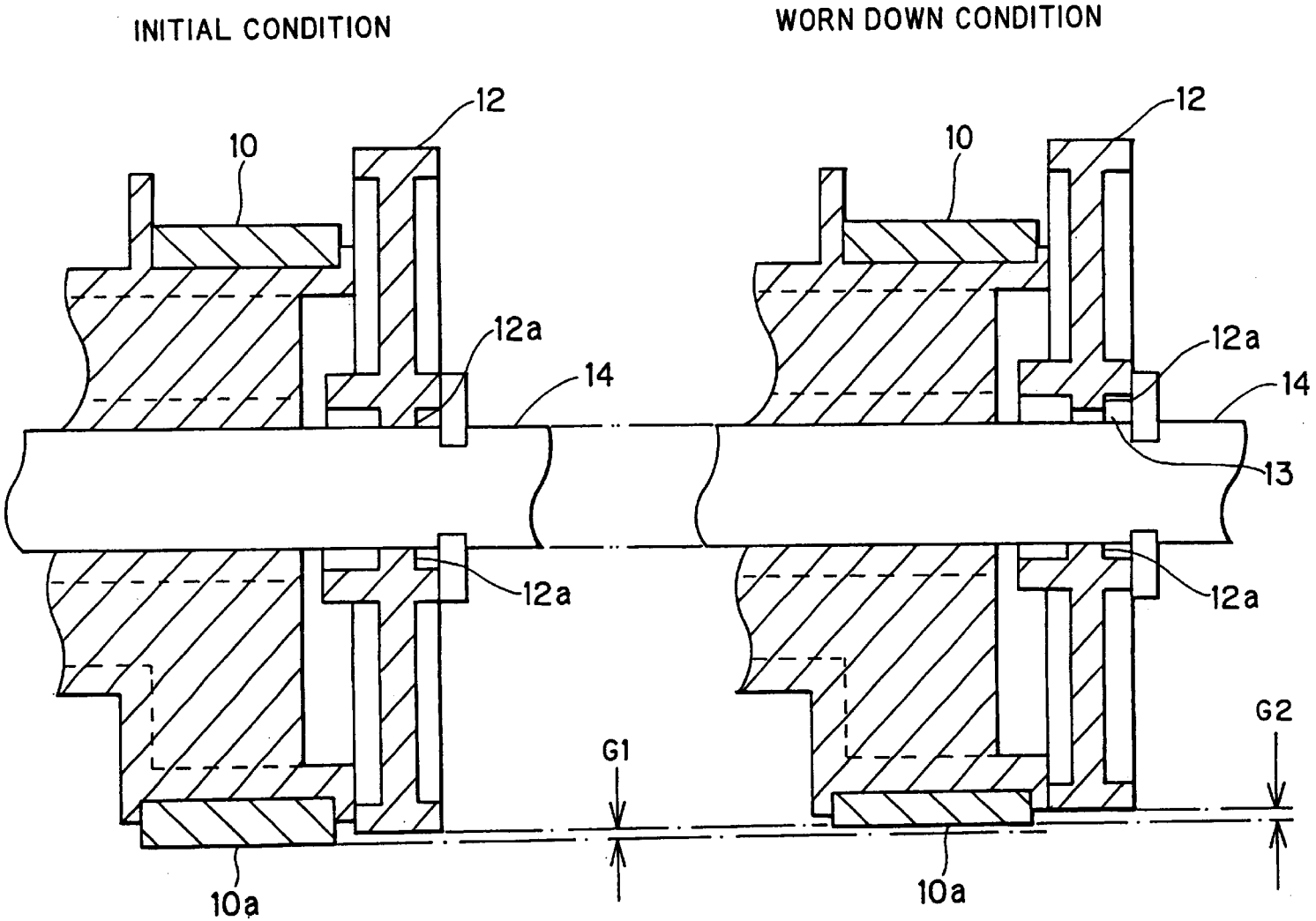
FIG. 5(*a*) is a magnified view showing the initial condition of the idle roller of the sheet supply roller of FIG. 4(*a*)

In the above-described sheet supply device 1, the large radius portion 10*a* of the sheet supply roller 10 is gradually worn down in association with passage of operation time, and the idle roller 12 is also worn down substantially at the same pace as the sheet supply roller 10. More specifically, as shown in FIG. 5(*a*), the idle roller 12 contacts the rotational shaft 14 only at the tips of the protrusions 12*a*. Therefore, when the idle roller 12 rotates relative to the rotational shaft 14, that is, when the rotational shaft 14 is driven to rotate or when the idle roller 12 freely rotates around the rotational shaft 14, friction between the tips of the protrusions 12*a* and the rotational shaft 14 gradually wears down the protrusions 12*a*. When the protrusions 12*a* are worn down, a distance between the tip of the protrusion 12*a* and an outer surface of the idle roller 12 decreases, and a certain amount of play 13 is generated between the tips of the protrusions 12*a* and the surface of the rotational shaft 14 as shown in FIG. 5(*b*). Because pressing force is generated between the idle roller 12 and the sheet S, the idle roller 12 is pressed away form the sheet S. Therefore, the play 13 is concentrated on the side of the rotational shaft 14 opposite from the sheet S. As the play 13 increases, the minimum distance between the rotational center of the rotational shaft 14 and the surface of the sheet S decreases.

As shown in FIG. 5(*a*), when the sheet supply device 1 is first used, the radius of the large radius portion 10*a* differs from the radius of the idle roller 12, more specifically, the radius from the rotational center of the rotational shaft 14 and the surface of the sheet S, by a difference G1. As shown in FIG. 5(*b*), even after the large radius portion 10*a* is worn down, the radius of the large radius portion 10*a* and the radius of the rotational shaft 14 still differ by a difference G2 which is substantially the same as the initial difference G1.

Figure 6:
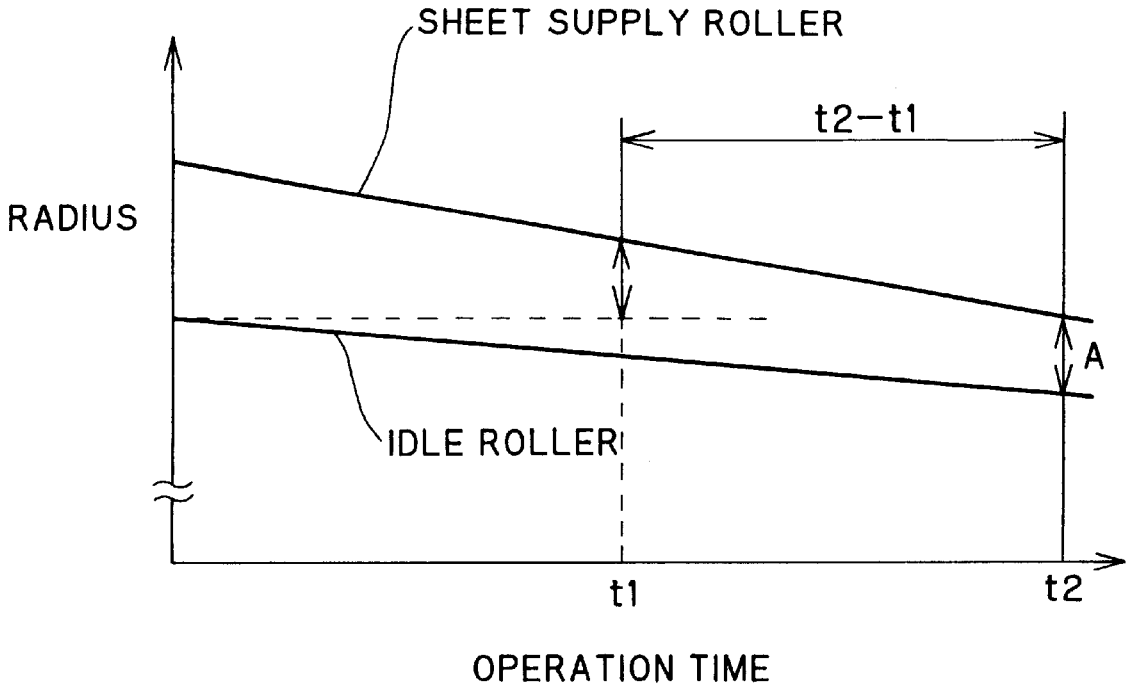
FIG. 6 is a graph showing a relationship of the radius of the sheet supply roller and the idle roller with respect to the cumulative operation time.
Figure 7A:
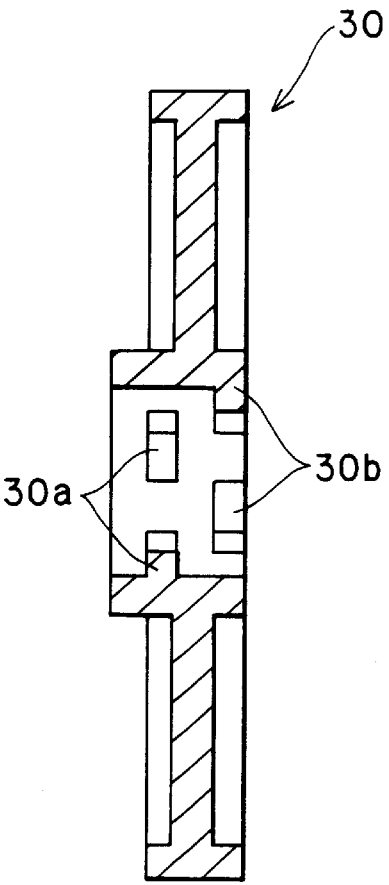
FIG. 7(*a*) is a cross-sectional view showing a modification of the idle roller of the embodiment.
Figure 7B:
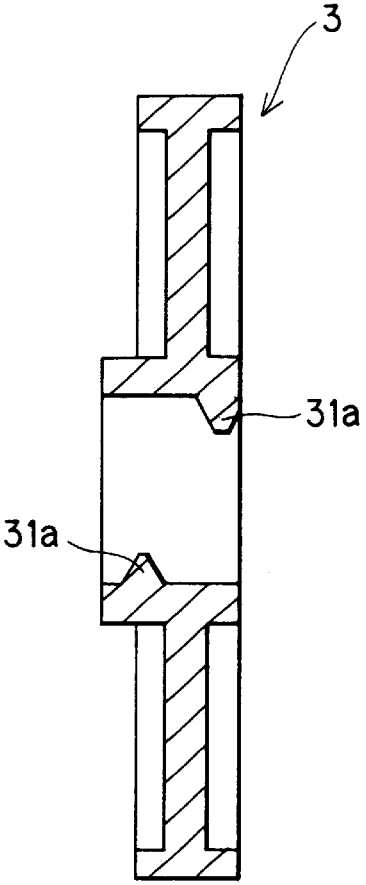
Figure 7C:
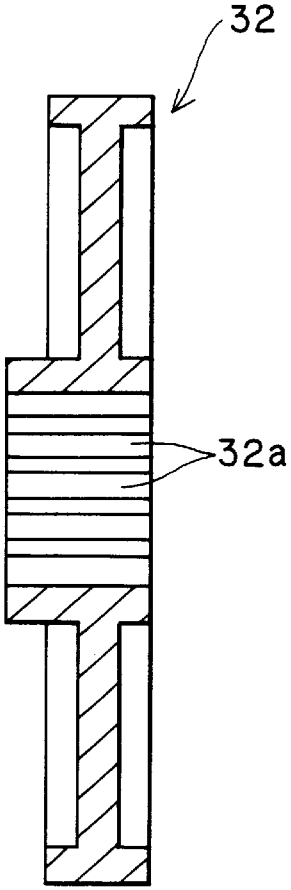
Figure 7D:
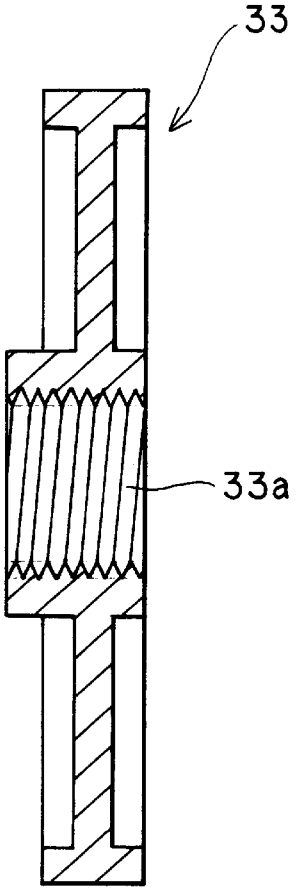

FIG. 6 graphically shows change in difference between the radius of the large radius portion 10*a* and the radius of the idle roller 12. As shown in FIG. 6, the radius of the idle roller 12 is gradually reduced at a slightly slower pace than the sheet supply roller 10. Therefore, even after the cumulative time t1, the radius difference between the radius of the large radius portion 10*a* and the radius of the idle roller 12 is still greater than the minimum tolerable value A. Therefore, the sheet supply roller 10 can be further operated. The radius difference will not reach the minimum tolerable value A until after a cumulative time t2. Accordingly the life of the sheet supply device 1 is lengthened by a time duration (t2−t1).

In this way, according to the sheet supply device 1 of the present invention, even after the sheet supply roller 10 is worn down, the frequency of pickup errors will not increase as quickly as in a conventional sheet supply device. Therefore, the sheet supply roller 10 can be used for a longer period of time, and cost for replacing the sheet supply roller 10 can be decreased.

While the invention has been described in detail with reference to specific embodiments thereof, it would be apparent to those skilled in the art that various changes and modifications may be made therein without departing from the spirit of the invention, the scope of which is defined by the attached claims.

For example, the idle roller 12 is formed with the annular protrusions 12*a* in the above-described embodiment so as to promote easy abrasion of the protrusions 12*a*. However, the idle roller 12 can have any of a variety of different types of uneven inner surfaces.

For example, an idle roller 30 is shown in FIG. 7(*a*). The idle roller 30 has an inner peripheral surface formed with a row of protrusions 30*a* and a row of protrusions 30*b*. Positions of the protrusions 30*a* and a row or protrusions 30*b*. Positions of the protrusions 30*a* are staggered with respect to positions of the protrusion 30*b*.

As shown in FIG. 7(*b*), an idle roller 31 has an inner peripheral surface formed with a plurality of protrusions 31*a*. The protrusions 31*a* are similar to the protrusions 12*a* of the idle roller 12. However, the protrusions 31*a* taper from a thick base to a point or near point. In other words, the protrusions 13*a* have a smaller cross-sectional area toward the center of the idle roller in its radius direction. Because the protrusions 31*a* are pointed, they are further easily worn down.

As shown in FIG. 7(*c*), an idle roller 32 has a geared inner surface defined by a plurality of protrusions 32*a*. The protrusions 32*a* are shaped like gear teeth. Each of the protrusions 32*a* has a smaller cross-sectional area toward the center of the idle roller 32 in its radius direction.

Also, as shown in FIG. 7(*d*), an idle roller 33 has inner peripheral surface formed with a spiral or screw-shaped groove 33*a*. Idle rollers 30, 31 and 32 may be formed by a molding technique, so the manufacturing process can be simplified. However, idle roller 33 may not be formed by such a technique.

Also, in the above-described embodiment, the idle roller 12 is abraded down at a portion contacting the rotational shaft 14. However, the idle roller 12 can be formed so that the outer peripheral surface of the idle roller 12 is abraded down by friction force generated between the idle roller 12 and the surface of the sheet S.

Figures 8A, 8B:
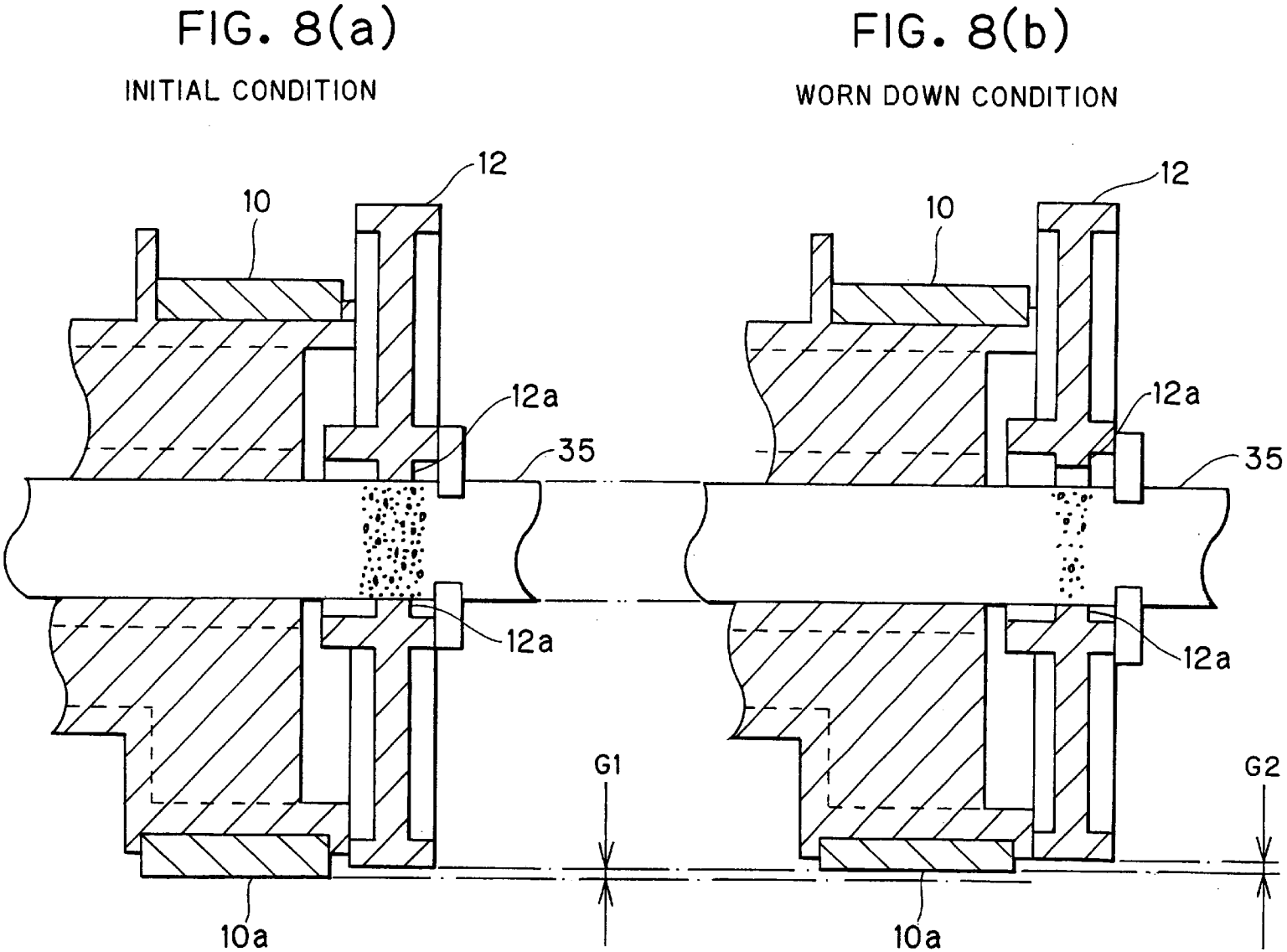
FIG. 8(*a*) is a magnified view showing the initial condition of a rotational shaft a sheet supply roller according to a modification of the present embodiment.

For example, as shown in FIGS. 8(*a*) and 8(*b*), the sheet supply device 1 can have a rotational shaft 35. The rotational shaft 35 has a rough outer peripheral surface which is abraded at least at portions to contact the protrusions 12*a* of the idle roller 12. The abraded outer surface of the rotational shaft 35 facilitates to wear down the idle roller 12.

It is conceivable to manufacture an idle roller having a conventional shape using an easily abradable material. However in this case, the idle roller may be unpredictably abraded down locally at undesired locations. This potential problem needs to be properly confronted when designing the idle roller. It is also conceivable to use an easily abradable material only at necessary locations and to use a conventional material at the rest of an idle roller. However, in this case, because a plurality of different materials is used, manufacturing costs may be increased.

What is claimed is:

1. A sheet supply device comprising:

a rotatable shaft;

a sheet supply roller that is fixed to the rotatable shaft such that the sheet supply roller rotates along with the rotatable shaft, the sheet supply roller supplying a recording medium in a predetermined direction while rotating, the sheet supply roller having a cross-section formed of a large radius segmental portion and a small radius segmental portion; and at least one idle roller that is freely rotatably mounted around the rotatable shaft, the idle roller having an inner surface to contact the rotatable shaft and an outer surface to contact the recording medium, the idle roller having a distance between the inner surface and the outer surface;

wherein at least one of the rotatable shaft and the inner surface of the idle roller is formed to facilitate wear on the inner surface of the idle roller in order to decrease the distance between the inner surface and the outer surface of the idle roller from a friction generated between the rotatable shaft and the inner surface of the idle roller.

2. The sheet supply device according to claim 1, wherein the large radius segmental portion of the sheet supply roller has an outer surface, and when the sheet supply roller supplies the recording medium, the outer surface of the large radius segmental portion of the sheet supply roller is worn down at a substantially same rate as the inner surface of the idle roller because of a friction generated between the outer surface of the large radius segmental portion of the sheet supply roller and the recording medium.

3. The sheet supply device according to claim 1, wherein the sheet supply roller is positioned between a pair of idle rollers.

4. The sheet supply device according to claim 1, wherein the inner surface of the idle roller is formed with a protrusion at which the idle roller contacts the rotatable shaft, and wherein when the idle roller rotates relative to the rotatable shaft, the protrusion is worn down.

5. The sheet supply device according to claim 4, wherein the protrusion has a smaller cross-sectional area toward a center of the idle roller in its radius direction.

6. The sheet supply device according to claim 4, wherein the protrusion has an annular shape.

7. The sheet supply device according to claim 4, wherein the inner surface of the idle roller is formed with a plurality of protrusions.

8. The sheet supply device according to claim 4, wherein the protrusion is formed at a predetermined position such that the idle roller is formed by a molding technique.

9. The sheet supply device according to claim 4, wherein the protrusion defines a spiral groove.

10. The sheet supply device according to claim 1, wherein the rotatable shaft has an abraded rough outer surface at least at a portion where the rotatable shaft contacts the inner surface of the idle roller, and wherein the abrade rough outer surface facilitates to wear down the inner surface of the idle roller.

11. The sheet supply device according to claim 1, wherein the idle roller is formed from polyacetals.

12. The sheet supply device according to claim 1, wherein the idle roller has a geared inner surface formed with a plurality of protrusions.

13. The sheet supply device according to claim 1, wherein the rotatable shaft is made from a nickel coated metal.

14. The sheet supply device according to claim 1, wherein the sheet supply roller comprise a plastic core and a rubber mounted over the plastic core.

* * * * *